US005868651A

United States Patent [19]

Washington

[11] Patent Number: 5,868,651

[45] Date of Patent: Feb. 9, 1999

[54] MULTI-FUNCTION EXERCISE DEVICE

[76] Inventor: Leonard A. Washington, 261 ½ Rylands St., Mobile, Ala. 36603

[21] Appl. No.: 996,024

[22] Filed: Dec. 22, 1997

[51] Int. Cl.[6] ..... A63B 21/00

[52] U.S. Cl. ..... 482/91; 482/122; 482/126

[58] Field of Search ..... 482/91, 92, 126, 482/122, 148, 140

[56] References Cited

U.S. PATENT DOCUMENTS

| | | | |
|---|---|---|---|
| 4,863,158 | 9/1989 | Tassone . | |
| 5,122,107 | 6/1992 | Gardner | 482/140 |
| 5,248,287 | 9/1993 | Nicoletti | 482/106 |
| 5,300,004 | 4/1994 | Muehlenbein | 482/140 |
| 5,372,558 | 12/1994 | Perry et al. | 482/49 |
| 5,372,566 | 12/1994 | Dischansky et al. | 482/140 |

*Primary Examiner*—Jerome W. Donnelly

*Attorney, Agent, or Firm*—Joseph N. Breaux

[57] ABSTRACT

A multi-function exercise device for facilitating waistline reducing exercises and for facilitating with arm and upper body strengthening and toning exercises wherein the waistline reducing exercises and the arm and upper body strengthening and toning exercises may be performed simultaneously or alternately. The multi-function exercise device comprises a center bar member, left side bar member and right side bar member wherein the left side bar member is pivotally coupled to the left end of the center bar member and the right side bar member is pivotally coupled to the right end of the center bar member. The pivotally couplings of the left side bar member and the right side bar member, respectively, provide left and right counter reciprocating resistance forces as the muscles of the left and right arms of the exerciser apply a force of pressure to urge the left side bar member and the right side bar member, respectively, forwardly.

4 Claims, 2 Drawing Sheets

MULTI-FUNCTION EXERCISE DEVICE

TECHNICAL FIELD

The present invention relates to exercise devices and, more particularly, to a multi-function exercise device for facilitating waistline reducing exercises and for facilitating with arm and upper body strengthening and toning exercises wherein the waistline reducing exercises and the arm and upper body strengthening and toning exercises may be performed simultaneously or alternately. Moreover, the multi-function exercise device can be used with abdominal exercises.

BACKGROUND OF THE INVENTION

Twisting the torso or waistline while standing in an upright position has been known to reduce the waistline. An exerciser has been known to use a bar member such as a pipe or broomstick positioned around the neck with their hands coupled thereto to facilitate the twisting and turning of the torso and waistline. However, the pipe and broom stick are uncomfortable when exercising because of the lack of padding on the pipe and broomstick for padding the neck. Moreover, since the arms while twisting the torso or waistline is maintained extended behind the shoulders or aligned with the shoulders, the force of the arms urges the broomstick or pipe into the neck.

Other exercises for reducing the waistline and abdomen include abdominal sit-ups or crunches. In some instances, the exerciser, while lying down, places their hands behind their head and applies a force of pressure to urge the head and a portion of the torso forward. Exercise devices have been employed to facilitate the abdominal sit-up or crunch.

Several devices have been patented which are aimed at exercising the waistline or abdomen.

U.S. Pat. No. 5,248,287, by Nicoletti, entitled "EXERCISE DEVICE" discloses an exercise device for facilitating trunk rotation exercises comprising a semicircular shaped elongated member with handles at each end. The handles extend toward each other across the front of the user and forces the user's hands to be located close to the upper torso of the body.

U.S. Pat. No. 5,372,566, by Olschansky et al., entitled "PORTABLE EXERCISING SYSTEM" discloses a stabilization mechanism for contact with a resistive force load applying mechanism. The stabilization mechanism is coupled to a force load application mechanism through an adjustable securement mechanism which adjusts the displacement distance between the stabilization mechanism and the force load application mechanism. The portable exercising system is primarily used for sit-up type exercises.

U.S. Pat. No. 5,122,107, by Gardner, entitled "SITUP EXERCISE HEAD-SUPPORT HARNESS" discloses a harness to be worn during sit-up exercises to support the head. The harness provides a handgrip loop from which the exerciser applies a force greater than the weight of the head to pull the head forward during sit-ups.

U.S. Pat. No. 4,863,158, by Tassone, entitled "SIT-UP EXERCISE AID" discloses a sit-up bar employed to add resistance for sit-up exercises. The sit-up bar has a central neck bow having coupled thereto right and left aligned straight sections. The sit-up bar further comprises a pair of handles each of which extends forward from a respective straight section. Weights may be coupled to the sit-up bar.

Another device in the abdomen exercise art is U.S. Pat. No. 5,330,004, by Meuhlenbein, entitled "ABDOMEN EXERCISER AND METHOD OF USING SAME" but does not meet the needs of the present invention.

When strengthening the arms and upper body, exercise devices which provide resistance forces have been employed such as described in U.S. Pat. No. 5,372,558, by Perry et al., entitled "EXERCISE DEVICE." The invention, by Perry et al., discloses an exercise apparatus for strengthening the muscles of the upper body and arm including a handle means, a connecting means and a bias means or counterweight system coupled to the handle means.

It can be readily seen that there exists the continuing need for a multi-function exercise device for facilitating waistline reducing exercises and for facilitating with arm and upper body strengthening and toning exercises wherein the waistline reducing exercises and the arm and upper body strengthening and toning exercises may be performed simultaneously or alternately. Moreover, the multi-function exercise device may be used with abdominal exercises.

SUMMARY OF THE INVENTION

The preferred embodiment of the multi-function exercise device of the present invention solves the aforementioned problems in a straight forward and simple manner. What is provided is a multi-function exercise device for facilitating waistline reducing exercises and for facilitating with arm and upper body strengthening and toning exercises wherein the waistline reducing exercises and the arm and upper body strengthening and toning exercises may be performed simultaneously or alternately. Moreover, the multi-function exercise device may be used with abdominal exercises.

The multi-function exercise device comprises a center bar member, a left side bar member and a right side bar member wherein the left side bar member is pivotally coupled to the left end of the center bar member and the right side bar member is pivotally coupled to the right end of the center bar member. The pivotal couplings of the left side bar member and the right side bar member, respectively, provide left and right counter reciprocating resistance forces as the muscles of the left and right arms of the exerciser apply a force of pressure to urge the left side bar member and the right side bar member, respectively, forwardly.

In view of the above, an object of the present invention is to provide a multi-function exercise device with a center bar member having at least a portion thereof padded for enhancing the comfort of the center bar member when disposed about the neck during the waistline reducing exercises and/or the arm and upper body toning and strengthening exercises. Furthermore, the left side bar member and the right side bar member each have handgrip pads for gripping the exerciser's hands therearound.

Another object of the present invention is to provide a multi-function device which can be used to facilitate the twisting and turning of the torso of the exerciser to reduce the waistline.

A further object of the present invention is to provide a multi-function exercise device which can be used to facilitate abdominal sit-ups or crunches.

It is a still further object of the present invention to provide a multi-function device which can be used to provide the necessary resistance forces to tone and strengthen the muscles of the arms and upper body while performing toning and strengthening exercises or while performing waistline reducing exercises.

It is a still further object of the present invention to provide a multi-function exercise device having the left side bar member and the right side bar member pivotally coupled to the center bar member via left and right recoil spring members, respectively, wherein the left and right recoil spring members maintain the left side bar member, the right side bar member and the center bar member substantially aligned in a straight line. As the right and left arms of the exerciser apply a force of pressure to the left side bar member and the right side bar member, respectively, the left and right recoil spring members pivot left side bar member and right side bar member, respectively, forwardly. Furthermore, as the exerciser removes the force of pressure, the left and right recoil spring members automatically pivot, left and right side bar members, respectively, such that left and right side bar members become aligned in a straight line with the center bar member.

It is a still further object of the present invention to provide a multi-function exercise device with pivoting members which increase the counter reciprocating resistance forces in response to increases in the force of pressure applied to by the exerciser's arms to the left and right side bar members.

Alternately, it is an object of the present invention to provide a multi-function device with a center bar member having left and right members which are slidably coupled telescopically to the left and right ends, respectively, of the center bar member for increasing or decreasing the length of the center bar member. Thereby, the length of the center bar member can be adjusted for varying shoulder widths.

Alternately, it is an object of the present invention to provide a multi-function device with lockable pivot members for pivoting left and right side bar members forwardly and locking the left and right side bar members in a forward position when desired.

It is a still further object of the present invention to provide a multi-function exercise device with a carry case having a handle for transporting the multi-function exercise device.

In view of the above objects, it is a feature of the present invention to provide a multi-function device which is simple and inexpensive to manufacture.

Another feature of the present invention is to provide a multi-function device which is relatively simple structurally.

A further feature of the present invention is to provide a multi-function device which is easy and comfortable to use.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF EXEMPLARY EMBODIMENT

Figure 1:
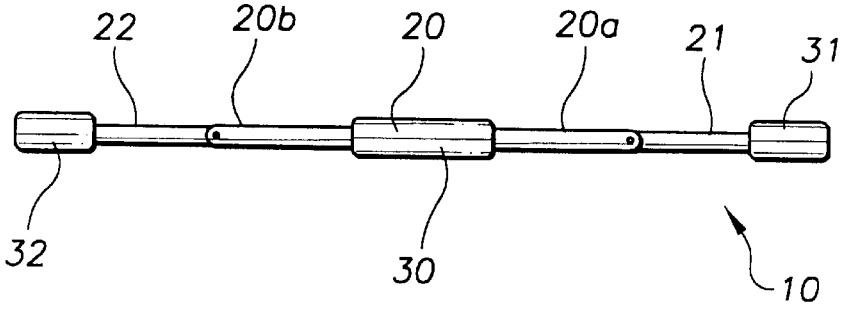
FIG. 1 illustrates a top view of the preferred embodiment of the multi-function exercise device of the present invention.
Figure 2:
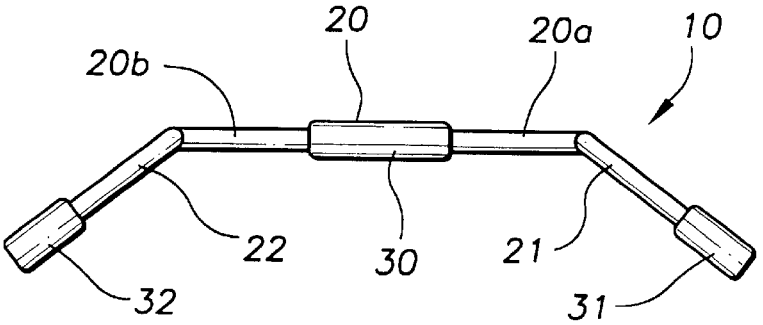
FIG. 2 illustrates a top view of the preferred embodiment of the multi-function exercise device of the present invention having the left side bar member and the right side bar member pivoted forwardly.
Figure 3:
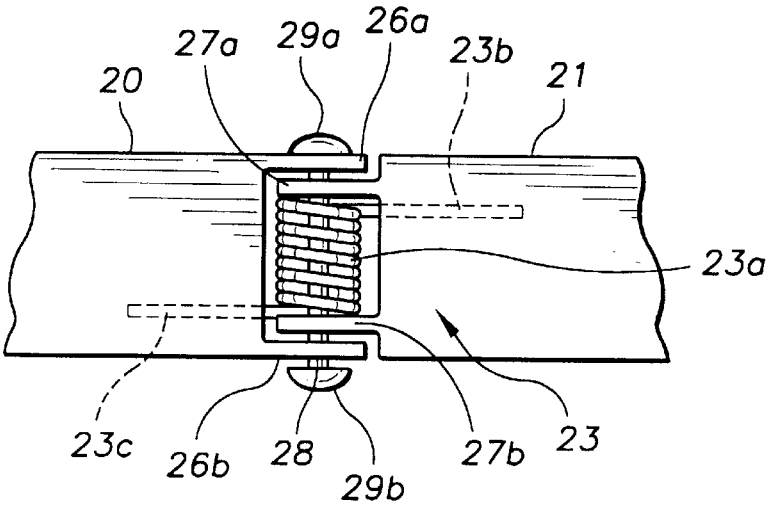
FIG. 3 illustrates the pivotal coupling via the pivoting member of the present invention of the left side bar member to the center bar member.

Referring now to the drawings, and in particular FIGS. 1 and 2, the multi-function exercise device of the present invention is designated generally by the numeral 10. Multi-function exercise device 10 is comprised of center bar member 20, left side bar member 21 and right side bar member 22. Left side bar member 21 is pivotally coupled via pivot member 23 to left end 20*a* of center bar member 20, as best seen in FIG. 3. Right side bar member 22 is pivotally coupled via a pivot member (not shown, identical to pivot member 23) to right end 20*b* of the center bar member 20.

In the preferred embodiment, center bar member 20, left side bar member 21 and right side bar member 22 are cylindrical bar members made of durable material such as, without limitation, stainless steel, durable plastic, or aluminum.

Center bar member 20 has coupled thereto center bar pad member 30. Center bar pad member 30 is a jacket pad coupled around center bar member 20. Center bar pad member 30 may be made of resilient material such as foam, rubber or rubber-like. For example, closed-cell or open-cell foam may be used. The thickness of the center bar pad member 30 such be sufficient to maintain comfort of multi-function exercise device 10 around the neck of the exerciser.

Left side bar member 21 and right side bar member 22 each have coupled thereto left and right gripping pad members 31 and 32, respectively. In the preferred embodiment, left gripping pad member 31 and right gripping pad members 31 and 32 are also made of resilient material such as, foam, rubber or rubber-like material. As shown, left gripping pad member 31 and right gripping pad member 32 have a cylindrical outer contour. However, left gripping pad member 31 and right gripping pad member 32 may have indentations formed therein which would conform to griped fingers of a hand. The left and right gripping pad members 31 and 32, preferably, provide a non-slip gripping surface for placement of the exerciser's hands.

Figure 4:
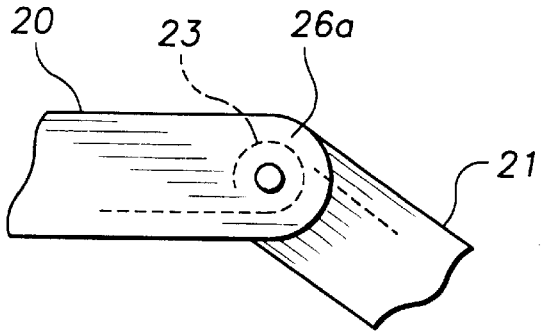
FIG. 4 illustrates a top view of the pivotal coupling of the present invention of the left side bar member to the center bar member.

Referring now to FIGS. 3 and 4, since the pivotal coupling of left side bar member 21 to center bar member 20 is the same as the pivotal coupling of right side bar member 22 to center bar member 20, only one such pivotal coupling will be described in detail. One distal end of left side bar member 21 is pivotally coupled to center bar member 20 via pivot member 23. Center bar member 20 has unitarily formed therewith top and bottom eyelets 26*a* and 26*b* spaces a predetermined distance from each other. Left side bar member 21 has coupled thereto top and bottom eyelets 27*a* and 27*b* spaced apart which align with top and bottom eyelets 26*a* and 26*b*, respectively, of center bar member 20. Preferably, the top surface of the top eyelet 27*a* and the bottom surface of bottom eyelets 27*b* of left side bar member 21 abut the bottom surface of eyelet 26*a* and the top surface of eyelet 26*b*, respectively, of center bar member 20. The distance between top and bottom eyelets 27*a* and 27*b*, receive therebetween pivot member 23. In the preferred embodiment pivot member 23 is a recoil spring member having center coil portion 23*a*, top recoil arm member 23*b* and bottom recoil arm 23*c*. Shaft 28 is journalled through top eyelets 26*a* and 27*a*, through center coil portion 23*a* and through bottom eyelets 26*b* and 27*b*. Shaft 28 has top and bottom head members 29*a* and 29*b* which are maintained on the outer surface of eyelets 26*a* and 26*b*, respectively, of center bar member 20 to secure shaft 28 in place.

Top recoil arm 23*b* extends in a hollow portion of left side bar member 21 and abuts against a side interior surface thereof. Bottom recoil arm 23*c* extends in a hollow portion of center bar member 20 and abuts against a side interior surface thereof.

In operation, as a force of pressure is applied to left side bar member 21, top recoil arm 23*b* flexes forwardly. As the force of pressure is removed, top recoil arm 23*b* automatically, flexes rearwardly until left side bar member 21 is aligned in a straight line with center bar member 20.

As can be appreciated, pivot member 23 maintains left side bar member 21 aligned with center bar member 20. More specifically pivot member 23 maintains left side bar member 21 and center bar member 20 in a straight line. Likewise, the pivot member (not shown) for coupling the right side bar member 22 to center bar member 20 maintains right side bar member 22 aligned with center bar member 20 such that right side bar member 22 and center bar member 20 are in a straight line. Additionally, pivot member 23 provides a counter reciprocating resistance force as the muscles of the left arm of the exerciser applies a force of pressure to urge left side bar member 21 forwardly. Likewise, the pivot member (not shown) coupling the right side bar member 21 to the center bar member 20 provides a counter reciprocating resistance forces as the muscles of the right arm of the exerciser applies a force of pressure to urge right side bar member 22 forwardly. The resistance forces of the pivot members (only 23 shown) serve to strengthen and tone the muscles of the left arm and the right arm when multi-function exercise device 10 is used with waistline reducing exercises such as when the exerciser twists the torso or waistline or when performing abdominal sit-ups or crunches.

Nevertheless, other resilient pivotal coupling arrangements may be substituted for the pivot members (only 23 shown) which would maintain left side bar member 21 and right side bar member 22 substantially in a straight line with center bar member 20 and allow left side bar member 21 and right side bar member 22 to flex forwardly while providing a counter reciprocating force.

Furthermore the exerciser may use multi-function exercise device 10 to strengthen and tone the arms and upper body while not performing waistline reducing exercises or abdominal sit-ups or crunches. When performing, strengthening and toning exercises for the arms and upper body, the exerciser, with the center bar member 20 behind the neck grips left and right gripping pad members 31 and 32, respectively, and applies a sufficient amount of force of pressure to pivot left side bar member 21 and right side bar member 22 forwardly. The pivot members (only 23 shown) provide counter reciprocating forces to strengthen and tone the muscles of the arms and upper body. Thereafter, the force of pressure may be held for a predetermined time or immediately released. The exerciser can repeat the exercise for as many times as desired. Furthermore, the strengthening and toning exercises for the arms and upper body may be performed without the need of the center bar member 20 positioned around the neck.

While performing waistline reducing exercises, the exerciser may stand in an erect position. The center bar member 20 of multi-function device 10 is, preferably, centered behind the neck. The exerciser grips left and right gripping pad members 31 and 32. The exerciser can then twist and turn the torso for reducing the waistline. Furthermore, the exerciser can bend side to side.

As can be appreciated, the pivotal coupling of the left and right side bar members 21 and 22 provide a degree of resiliency to minimize muscle strain and discomfort in the arms and/or back when performing the waistline reducing exercise.

Alternately, while performing waistline reducing exercises, the exerciser while griping left and right gripping pad members 31 and 32 can apply a sufficient amount of force of pressure to pivot left side bar member 21 and right side bar member 22 forwardly for simultaneously toning and strengthening the arms and upper body.

Figure 6:
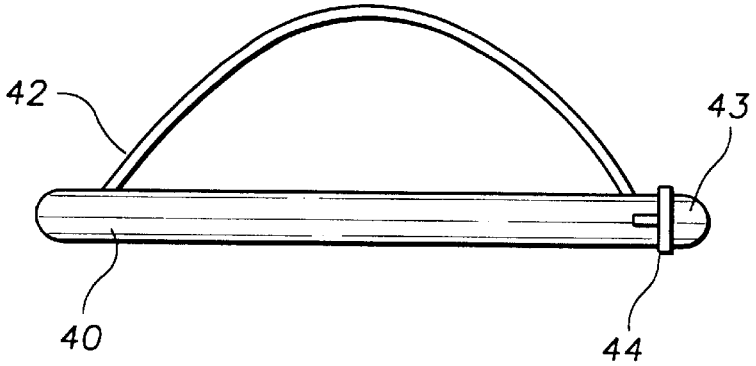

Referring now to FIG. 6, multi-function exercise device 10 further comprises carry case 40 for storing therein multi-function exercise device 10. Carry case 40 is an elongated hollow cylindrical enclosure having coupled thereto handle member 42. One end of the elongate hollow cylindrical enclosure has coupled thereto opening and closing member 43. Opening and closing member 43 is secured to the elongated hollow cylindrical enclosure via a securing means 44 such as, without limitation, a zipper, VELCRO, latching mechanism or the like.

In the preferred embodiment, handle member 42 has a length which allows handle member 42 to serve as a shoulder strap. Nevertheless, handle member 42 may have a shorter length which can be griped by the hands for toting carry case 40.

Figure 5:
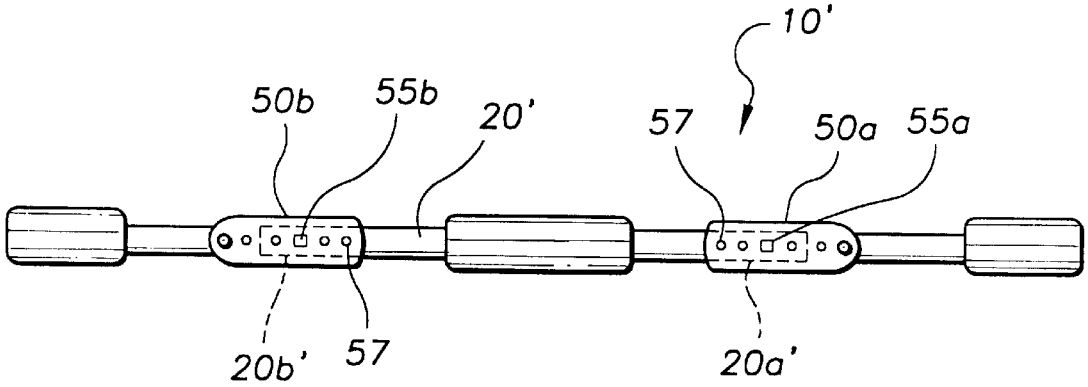
FIG. 5 illustrates a top view of an alternative embodiment of the multi-function exercise device of the present invention; and, FIG. 6 illustrates a portable carry case for transporting the multi-function exercise device of the present invention.

Referring now to FIG. 5, an alternate embodiment of the multi-function exercise device is illustrated. In the alternate embodiment multi-function exercise device 10' is primarily used for waistline reducing exercises or abdominal reducing exercises. Center bar member 20' of multi-function exercise device 10' comprises telescopic left and right members 50*a* and 50*b*. A portion of left end 20*a'* of center bar member 20' is slidably received in telescopic left member 50*a* and a portion of right end 20*b'* of center bar member 20' is slidably received in telescopic right member 50*b*. The telescopic properties of left and right members 50*a* and 50*b* allow the length of multi-function exercise device 10' to be increased or decreased as desired. When left and right members 50*a* and 50*b*, respectively, are slid to their desired position, for increasing or decreasing the length of center bar member 20' of multi-function exercise device 101, left and right members 50*a* and 50*b* are secured to center bar member 20' via locking mechanisms 55*a* and 55*b*, respectively. For example, locking mechanisms 55*a* and 55*b* each comprise a push button release member coupled to left end 20*a'* and right end 20*b'*, respectively, of center bar member 20'. Left and right members 50*a* and 50*b* each have formed therein a plurality of apertures 57 for receiving therein their respective push button release member. As the push button release members project through a respective one of the plurality of apertures, left and right members 50*a* and 50*b* are secured to a predetermined position. When the push button release members are pressed, the push button release members exit the respective one of the plurality of apertures thereby allowing left and right members 50*a* and 50*b* to be slide to a desire position. As can be appreciated, the length of center bar member 20' can be adjusted to accommodate varying shoulder widths for enhancing the comfort of multi-function exercise device 10'.

Nevertheless, left and right members 50*a* and 50*b* may be telescopically coupled and secured to center bar member 201 in any number of conventional ways. For example, locking pins coupled be used. Left side bar member 21' pivotally coupled to left member 50*a* of center bar member 20' and right side bar member 22' is pivotally coupled to right member 50*b* of center bar member 20' in the manner as described above in relation to FIGS. 3 and 4.

Alternately, in lieu of using a recoil spring member for pivotally coupling left side bar member 21' to left member 50*a* and a recoil spring member for pivotally coupling right side bar member 22' to right member 50*b*, a lockable pivot coupling may be substituted for each recoil spring member. The lockable pivot coupling would serve to pivot left side bar member 21' and right side bar member 22' forwardly to a desired position and lock such forward position in place. For example, a push button or locking pin could be used to release and/or lock the forward pivot position of the forwardly pivoted left side bar member 21' and right side bar member 22'.

It is noted that the embodiment of the multi-function exercise device described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An exercise device for assisting an exerciser in performing waistline reducing exercises or abdominal exercises comprising:

a center bar member positionable behind an exerciser's neck, said center bar member including left and right telescopic members which serve to increase or decrease the length of said center bar member;

a left side bar member pivotally coupled to a left end of said center bar member via a left pivot member and grippable by a left hand of the exerciser; and, a right side bar member pivotally coupled to a right end of said center bar member via a right pivot member and grippable by a right hand of the exerciser;

said left side bar member and the right side bar member being pivotally coupled to said left and right telescopic members, respectively, via left and right lockable pivot couplings, respectively.

2. An exercise device for assisting an exerciser in performing waistline reducing exercises and for facilitating with arm and upper body strengthening and toning exercises wherein the waistline reducing exercises and the arm and upper body strengthening and toning exercises may be performed simultaneously or alternately comprising:

a center bar member positionable behind an exerciser's neck, said center bar member including left and right telescopic members which serve to increase or decrease the length of center bar member;

a left side bar member pivotally coupled to a left end of said center bar member via a left means for pivoting and grippables by a left hand of the exerciser; and, a right side bar member pivotally coupled to a right end of said center bar member via a right means for pivoting and grippable by a right hand of the exerciser;

said left side bar member and said right side bar member are pivotally coupled to said left and right telescopic members, respectively, and wherein said left pivot means and said right pivot means are lockable.

3. An exercise device for assisting an exerciser in performing exercises comprising:

a center bar member positionable behind an exerciser's neck wherein said center bar member comprises left and right telescopic members which serve to increasing or decreasing the length of said center bar member;

a left side bar member pivotally coupled to the left telescopic member of said center bar member via a left pivot member and grippable by a left hand of the exerciser; and, a right side bar member pivotally coupled to the right telescopic member of said center bar member via a right pivot member and grippable by a right hand of the exerciser;

said left pivot member and said right pivot member providing left and right counter reciprocating resistance forces, respectively, as the muscles of the left and right arms of an exerciser apply a force of pressure to urge the left side bar member and the right side bar member, respectively, forwardly.

4. The exercise device of claim 3, wherein the left and right pivot members are left and right recoil spring members, respectively, wherein the left and right recoil spring members maintain the left side bar member, the right side bar member and the center bar member substantially aligned in a straight line; wherein, as the right and left arms of an exerciser apply a force of pressure to the left side bar member and the right side bar member, respectively, the left and right recoil spring members pivot left side bar member and right side bar member, respectively, forwardly; and, wherein, as the exerciser removes the force of pressure, the left and right recoil spring members automatically pivot rearwardly, left and right side bar member, respectively, until the left and right side bar members become aligned in the straight line with the center bar member.

* * * * *